United States Patent [19]

Moore

[11] Patent Number: 4,884,534

[45] Date of Patent: Dec. 5, 1989

[54] FUEL AND AIR INDUCTION STRUCTURE AND MECHANISM FOR INTERNAL COMBUSTION ENGINES

[75] Inventor: Jesse C. Moore, Celina, Ohio

[73] Assignee: J. C. Moore Research, Inc., Celina, Ohio

[21] Appl. No.: 275,936

[22] Filed: Nov. 25, 1988

[51] Int. Cl.[4] ..... F02B 75/18

[52] U.S. Cl. ..... 123/52 MV; 123/590

[58] Field of Search ..... 123/52 MV, 590

[56] References Cited

U.S. PATENT DOCUMENTS

| | | | |
|---|---|---|---|
| 906,393 | 12/1908 | Dock | 123/52 ML |
| 1,454,596 | 5/1923 | Ball | 123/52 ML |
| 1,471,822 | 10/1923 | Bossi | 123/52 ML |
| 1,597,882 | 8/1926 | Hackethal | 123/52 ML |
| 1,608,762 | 11/1926 | Ball | 123/52 ML |
| 1,938,164 | 12/1933 | Zurmuhle | 123/52 ML |
| 2,272,418 | 2/1942 | Méry | 123/52 ML |
| 2,980,087 | 4/1961 | Ball | 123/52 ML |
| 3,042,015 | 7/1962 | Peterson | 123/52 ML |
| 3,780,719 | 12/1973 | Weiertz | 123/52 ML |

FOREIGN PATENT DOCUMENTS

| | | | |
|---|---|---|---|
| 139013 | 12/1978 | Japan | 123/52 ML |

*Primary Examiner*—E. Rollins Cross

*Attorney, Agent, or Firm*—Jacox & Meckstroth

[57] ABSTRACT

Structure and a method for introduction of a mixture of fuel and air into the combustion chambers of an internal combustion engine which has a plurality of combustion chambers. Each combustion chamber having an intake port region which leads to the combustion chamber. The structure has an inlet manifold which has fluid communication with the intake port region of each of the combustion chambers. The structure also has an outlet manifold which has fluid communication with the intake port region of each of the combustion chambers. A fluid pump forces continuous circulation of the mixture of fuel and air flows from one manifold to the other manifold as the two manifolds are arranged in series relationship. Thus, at any given period of time, the same quantity and the same composition of fuel and air is available at all of the combustion chambers, and engine operation is enhanced. The structure also includes fluid conduit members which direct the mixture of fuel and air against the hot walls of the intake port regions for vaporization of the fuel in the mixture of fuel and air.

10 Claims, 2 Drawing Sheets

FUEL AND AIR INDUCTION STRUCTURE AND MECHANISM FOR INTERNAL COMBUSTION ENGINES

BACKGROUND OF THE INVENTION

Internal combustion multi-cylinder engines of the spark ignition type have several deficiencies. One deficiency pertains to the fact that the quantity of fuel delivered to all cylinders or combustion chambers at any given time is not precisely the same. This results in an imbalance in power output of the combustion chambers of the engine. Another deficiency pertains to the fact that a of each exhaust cycle the inlet valve to the cylinder is slightly open. At this moment the pressure in the cylinder or combustion chamber is slightly above atmospheric pressure. Also, at this time the entire intake manifold area is under substantial vacuum. Therefore, a momentary back-flow occurs from the combustion chamber, and hot residual exhaust gases flow from the combustion chamber into the intake port areas. These hot exhaust gases constitute a detriment to the efficiency of operation of the engine.

U.S. Pat. Nos. 906,393, 1,471,822, 1,454,596, 1,597,882, 1,608,762, 1,938,164, 2,272,418, 2,980,087, pertain to manifold systems in internal combustion engines. However, none of these patents discloses structure or a method for solution of the problems set forth above.

It is an object of this invention to provide structure and mechanism for a multi-cylinder internal combustion engine in which the quantity and composition of fuel and air as a mixture at any given time is always precisely the same at all of the combustion chambers.

Another object of this invention is to provide means by which the hot residual exhaust gases are employed to enhance operation of the engine, rather than serving as a detriment to engine operation.

It is another object of this invention to provide mechanism for a multi-cylinder internal combustion engine by which efficiency of operation of the engine is higher than in conventional multi-cylinder internal combustion engines.

Another object of this invention is to provide such structure and mechanism which can be readily combined with any conventional internal combustion engine.

Other objects and advantages of this invention reside in the construction of structure and the parts thereof, the combination thereof, the method of construction and the mode of operation, as will become more apparent from the following description.

SUMMARY OF THE INVENTION

This invention comprises fuel and air induction structure and mechanism which enhances combustion within the combustion chambers in a multi-cylinder internal combustion engine. The invention comprises a first manifold which is in fluid communication with all of the combustion chambers of the engine. Means are provided for conducting an air and fuel mixture into the first manifold. Adjacent each combustion chamber and leading to each combustion chamber in the engine is an intake port region. Adjacent each intake port region and in direct communication therewith is a conduit member which leads to a second manifold. The second manifold leads to a fluid pump. The fluid pump operates to circulate fuel and air as a mixture from the first manifold to the second manifold and from the second manifold to the first manifold. Thus, fuel and air as a mixture enters the first manifold and travels to the intake ports of the combustion chambers. Each of the combustion chambers has an intake valve which opens and closes in the conventional manner. When an intake valve of a combustion chamber is closed, all of the fluid in the intake port region flows from the intake port region through the conduit member into the second manifold and to the fluid pump. The fluid then is forced by the fluid pump into the first manifold for flow to all of the intake port regions.

The fluid mixture continues to circulate as the fluid mixture flows from one manifold to the other manifold, as movement of the fluid is forced by the fluid pump. As an intake valve opens in one of the combustion chambers, a portion of the fluid mixture flows into the combustion chamber, the remaining portions of the fluid mixture continue to circulate in the manifolds.

Near the end of each exhaust stroke of the piston within each combustion chamber, the intake valve thereof begins to open. At this moment the pressure in the combustion chamber is slightly above atmospheric pressure. The entire manifold area at this moment has a pressure below atmospheric pressure. Therefore, at this moment hot residual exhaust gases flow from the combustion chamber and into the intake port area. In this invention these hot exhaust gases are drawn by the fluid pump and flow into the second manifold for mixing with the fuel and air and for circulation in the manifolds. These hot exhaust gases are mixed with the mixture of fuel and air and aid in vaporization of the fuel in the mixture. Thus, better combustion occurs as the fuel and air mixture flows into the combustion chambers and as the intake valves sequentially open.

DETAILED DESCRIPTION OF THE PREFERRED EMBODIMENT

Figure 1:
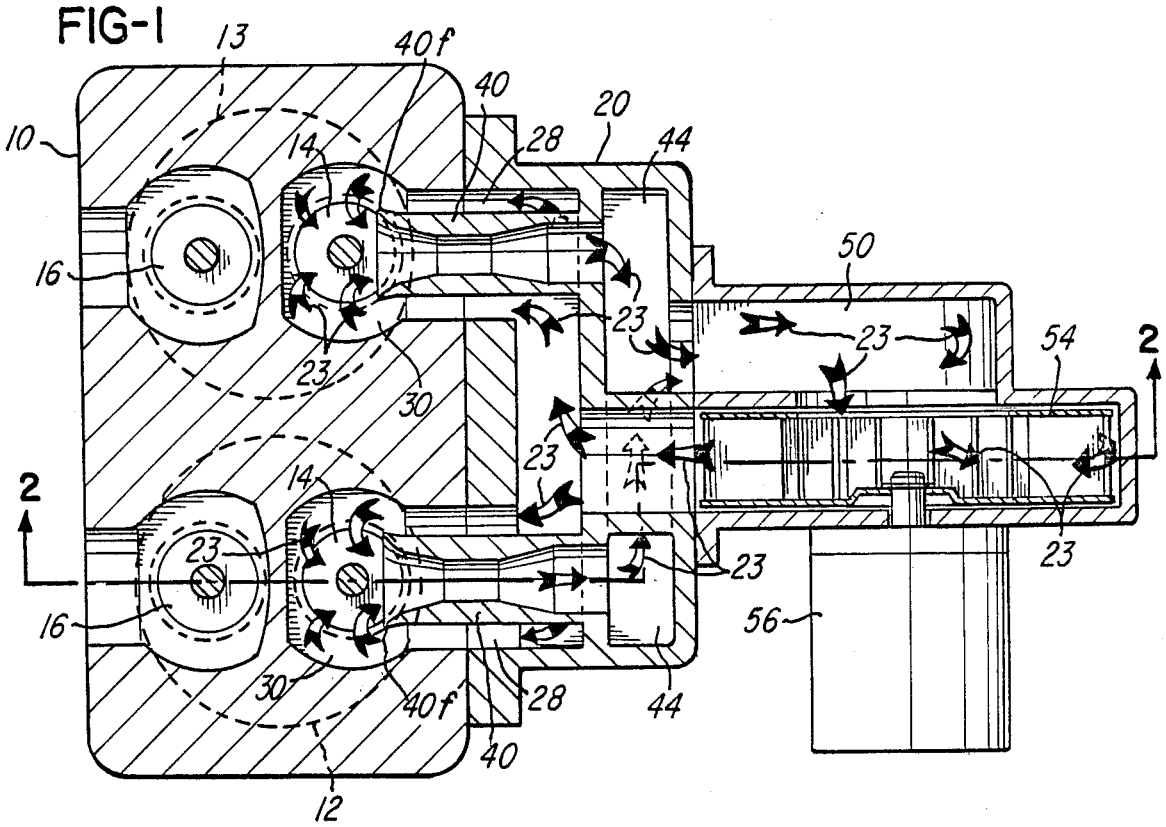
FIG. 1 is a sectional view showing the induction structure and mechanism of this invention. This view also illustrates flow of gases within the structure.

The figures of the drawings illustrate a portion of an internal combustion engine having a cylinder block 10. As shown in FIG. 1, within the cylinder block 10 are combustion chambers 12 and 13. Within each combustion chamber 12 and 13 are an intake valve 14 and an exhaust valve 16. The fuel and air induction structure and mechanism of this invention comprises a housing 20 which is attached to the cylinder block 10.

The housing 20 has an entrance passage 22 through which a mixture of fuel and air enters the housing 20. The fuel and air mixture is illustrated by arrows 23. Shown within the entrance passage 22 is a pivotally mounted throttle plate 24 which controls the volume of the mixture 23 of fuel and air flowing into the housing 20. The mixture 23 of fuel and air flows from the entrance passage 22 into a connector passage 25 and then into an upper manifold passage 26 which leads to a plurality of intermediate ports 28. Each intermediate port 28 leads to an intake or inlet port region 30 of each of the combustion chambers 12 and 13. Thus, the upper manifold passage 26 is always in fluid communication with all of the intermediate ports 28, there being one intermediate port 28 for each of the inlet port regions 30 of each of the combustion chambers 12 and 13. Each of the combustion chambers 12 and 13 has an inlet or intake port 34 which is closed and opened by movement of the intake valve 14 thereof.

Each intake port region 30 is formed by walls which are heated by operation of the internal combustion engine which includes the cylinder block 10 and each intake port region 30.

Figure 2:
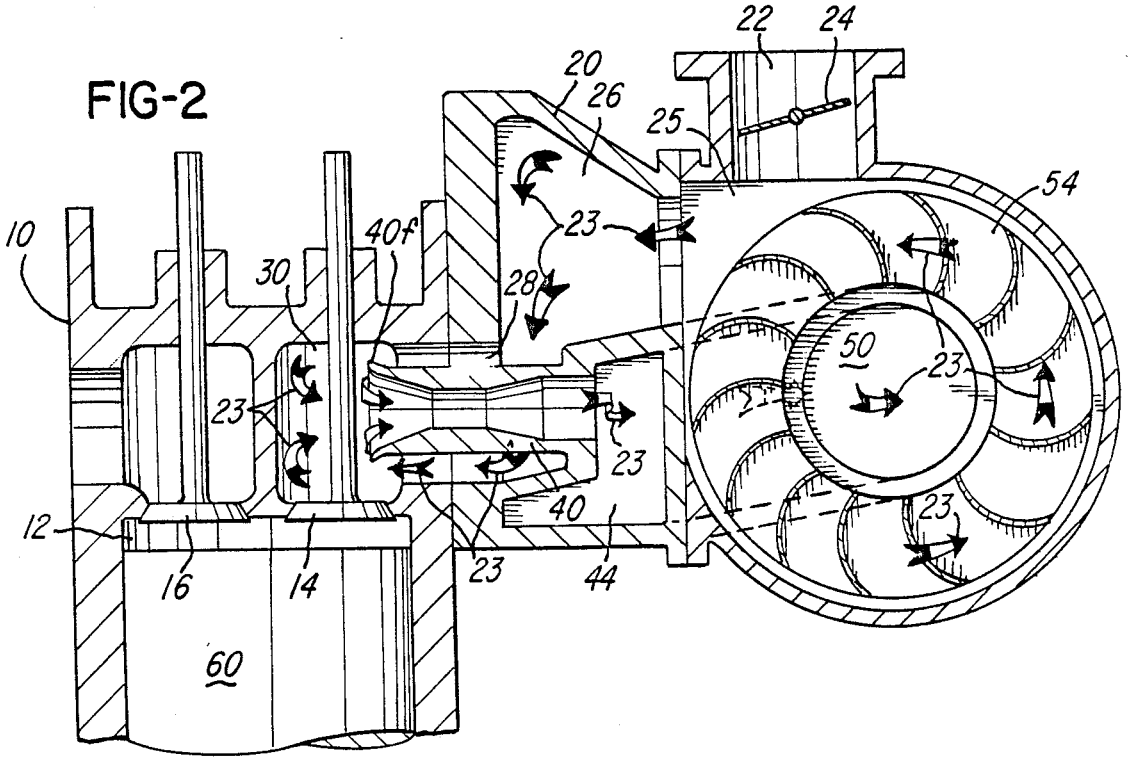
FIG. 2 is a sectional view taken substantially on line 2—2 of FIG. 1. This view shows the intake valve of one of the combustion chambers in a closed condition.

FIG. 2 shows the combustion chamber 12 at a moment in which the intake port 34 is closed by the intake valve 14. Therefore, at this moment all the fuel and air mixture 23 in the intake port region 30 flows from the inlet port region 30 into a conduit 40 which has a portion within the intake port region 30. The conduit 40 has a flared end portion **40*f*. The interior and exterior surfaces of the flared end portion 40*f*** are flared.

As the fuel and air mixture 23 flows through each of the intermediate ports 28 and into the respective inlet port region 30, the fuel and air mixture 23 engages the exterior surface of the flared end portion **40*f* of the respective conduit 40. Thus, the fuel and air mixture 23 is deflected against the hot wall surfaces of the intake port region 30. Thus, the hot wall surfaces of the intake port region serve as means to vaporize the fuel in the fuel and air mixture 23**.

Thus, the mixture 23 of fuel and air flows from the intake port region 30 into the conduit 40 and travels into a lower manifold passage 44. The lower manifold passage 44 is in fluid communication with all of the conduits 40, as each combustion chamber 12 and 13 has a conduit 40 within the inlet port region 30 thereof. The lower manifold passage 44 leads to a passage 50 which directs fluid into the axial portion of a fluid pump or blower 54. The blower or fluid pump 54 forces the mixture 23 of fuel and air into the connector passage 25, as illustrated in FIG. 2. Thus, the fluid pump 54 creates a continuous circulation of the mixture 23 of fuel and air within the housing 20, as illustrated in FIG. 2. A motor 56, such as an electric motor, operates continuously during operation of the internal combustion engine and continuously operates the blower or fluid pump 54.

Figure 3:
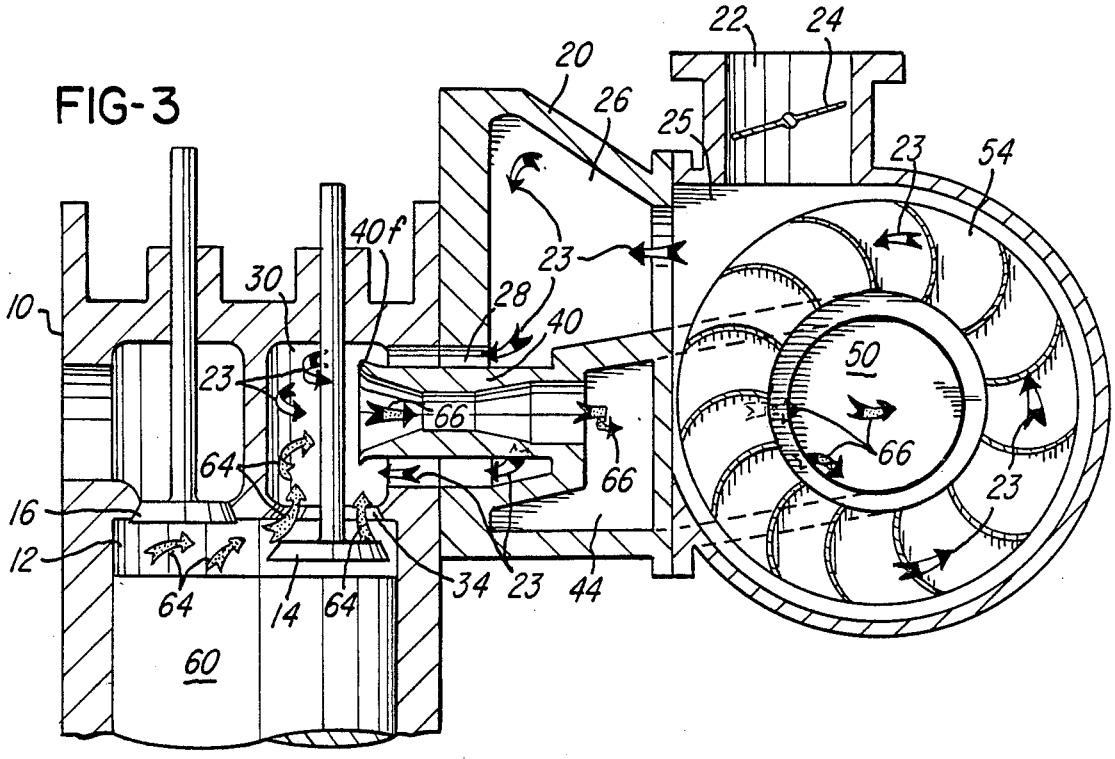
FIG. 3 is a sectional view, similar to FIG. 2. This view shows the intake valve of FIG. 2 in an open position near the end of an exhaust stroke within the combustion chamber. This view also illustrates flow of hot residual exhaust gases from the combustion chamber, as the hot residual exhaust gases are mixed with fuel and air within the induction structure.

FIG. 3 shows a piston 60 and illustrates conditions at a moment when the piston 60 is completing its exhaust stroke in the combustion chamber 12. At this moment the inlet valve 14 is beginning to open and is moved from the intake opening 34. At this moment there are hot residual exhaust gases 64 flowing through the opening 34 and into the inlet port region 30, as illustrated in FIG. 3. Within the inlet port region 30, the hot exhaust gases begin to mix with the fuel and air mixture 23, as illustrated by arrows 66 in FIG. 3. The volume of the hot exhaust gases 64 is small compared to the volume of the fuel and air mixture 23.

The fuel and air mixture 23 and the hot exhaust gases 64 flow from the inlet port region 30 and into the conduit 40, as illustrated in FIG. 3. The interior surface of the flared entrance portion **40*f* of the conduit 40 provides an enlarged region for collecting the hot residual gases 64 which flow into the conduit 40. The hot exhaust gases 64 are further mixed with the fuel and air mixture 23 during flow within the conduit 40, as illustrated by arrows 66. The mixture 66 of fuel and air and hot exhaust gases travels from the conduit 40 and into the lower manifold passage 44. The hot exhaust gases 64 heat the fuel in the mixture 66 and aid in vaporization of the fuel in the mixture 66. The mixture 66 of fuel, air, and a small volume of hot exhaust gases travels through the lower manifold passage 44, into the passage 50, and this mixture 66 is then forced by the fluid pump 54 into the connector passage 25 and then into the upper manifold passage 26. Thus, there is circulation of the mixtures 23 and 66 within the upper manifold passage 26 and within the lower manifold passage 44. Due to the fact that the hot exhaust gases 64 are very small in volume compared to the volume of the mixture 66, the entire mixture in circulation in the manifolds 26 and 44 may be considered to be substantially the mixture 23** of fuel and air.

Figure 4:
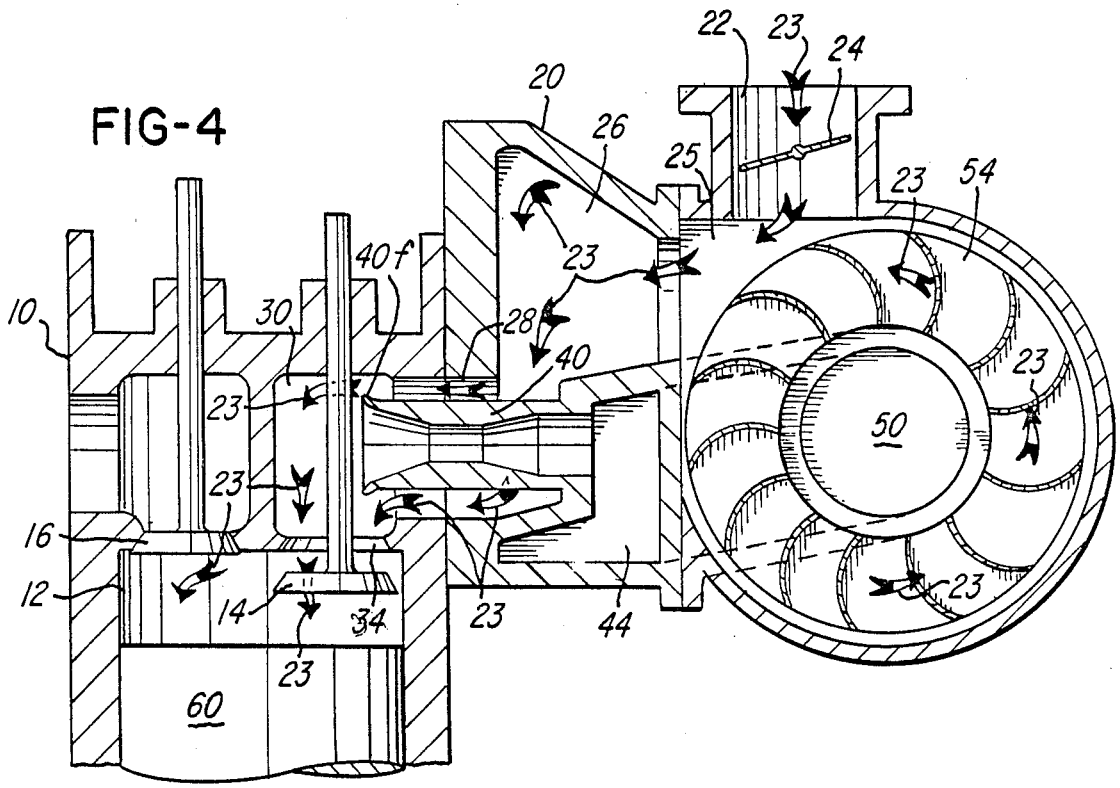
FIG. 4 is a sectional view, similar to FIGS. 2 and 3. This view shows the intake valve of FIGS. 2 and 3 in an open position at the beginning of an intake stroke of a piston within the combustion chamber. This view illustrates flow of the fuel and air mixture into the combustion chamber.

FIG. 4 illustrates the structure and mechanism at a moment in which the valve 14 is in an open condition and the piston 60 is traveling downwardly as an intake stroke within the combustion chamber 12. Thus, a portion of the fuel and air mixture 23 flows into the combustion chamber 12, as illustrated in FIG. 4. Portions of the fuel and air mixture 23 which do not flow into the combustion chamber 12 continue to circulate in the upper manifold passage 26 and in the lower manifold passage 44.

Thus, it is understood that the induction structure and mechanism of this invention provides, at any moment of time, the same mixture and the same volume of fuel and air to all of the combustion chambers of a multi-cylinder internal combustion engine. Thus, maximum efficiency in engine operation is available. Furthermore, the hot exhaust gases 64 are employed to aid in vaporization of the fuel in the fuel and air mixture 23.

Although the preferred embodiment of the structure and mechanism of this invention has been described, it will be understood that within the purview of this invention various changes may be made in the form, details, proportion and arrangement of parts, the combination thereof, and the mode of operation, which generally stated consist in a fuel and air induction structure and mechanism for internal combustion engines within the scope of the appended claims.

The invention having been described, the following is claimed:

1. Fluid induction structure for an internal combustion engine which has a plurality of combustion chambers, there being an inlet port region adjacent each combustion chamber, each inlet port region being formed by walls which are heated by operation of the internal combustion engine, there being a plurality of valves in which there is a valve which is operable to open and to close each combustion chamber, each valve in the open position thereof permitting fluid communication between the respective combustion chamber and the respective inlet port region, the induction structure comprising means forming an inlet passage for flow of fuel and air as a mixture into the structure, means forming a first fluid manifold, means forming a connection passage for fluid communication between the inlet passage and the first fluid manifold, means forming a plurality of intermediate passages for fluid communication between each inlet port region and the first fluid manifold, whereby the first fluid manifold is in fluid communication with the inlet port regions of all of the combustion chambers, means forming a second fluid manifold, means forming a plurality of fluid conduit members, there being a fluid conduit member adjacent the inlet port region of each of the combustion chambers and in fluid communication with the second fluid manifold, a continuously operating fluid pump, means forming a first transfer passage, the first transfer passage providing fluid communication between the second fluid manifold and the fluid pump, means forming a second transfer passage, the second transfer passage providing fluid communication between the first fluid manifold and the fluid pump, whereby fuel and air as a mixture flows into the first fluid manifold and from the first fluid manifold to all of the inlet port regions of the combustion chambers, the fuel and air as a mixture then flowing from each of the inlet port regions and into each respective fluid conduit member, the fuel and air as a mixture then flowing in each of the fluid conduit members to the second fluid manifold and from the second fluid manifold to the fluid pump and from the fluid pump to the first fluid manifold, whereby there is continuous circulation of fuel and air as a mixture within the fluid manifolds, and whereby a portion of the fuel and air as a mixture flows from each inlet port region and into its respective combustion chamber when the valve of the combustion chamber is in an open position.

2. The fluid induction structure of claim 1 in which each fluid conduit member comprises a relatively short tubular member.

3. The fluid induction structure of claim 1 in which each fluid conduit member comprises a relatively short tubular member having an exterior outwardly flared end portion within the respective inlet port region, whereby fuel and air as a mixture flows in engagement with the exterior outwardly flared end portion of the short tubular member and is deflected by the exterior outwardly flared end portion and engages the heated walls which form the inlet port region, for vaporization of the fuel in the fuel and air as a mixture prior to flow of the fuel and air as a mixture into a combustion chamber.

4. The fluid induction structure of claim 1 in which each fluid conduit member comprises a relatively short tubular member having an end portion provided with an internal flared entrance surface within the respective inlet port region, whereby a wide entrance area is provided for flow of gases from the respective inlet port region into the fluid conduit member.

5. Fluid induction structure for an internal combustion engine provided with a plurality of combustion chambers and a plurality of intake valves, there being an intake valve for each of the combustion chambers, each intake valve being operable to close and to open the respective combustion chamber, comprising means forming first fluid conduit means, the first fluid conduit means leading to all of the combustion chambers, means forming inlet passage means in fluid communication with the first fluid conduit means for passage of fuel and air as a mixture into the fluid induction structure and to the first fluid conduit means, a fluid pump, means forming second fluid conduit means, the second fluid conduit means including separate conduit portions and a main portion, each of the separate conduit portions leading from one of the combustion chambers to the main portion of the second fluid conduit means, and the main portion of the second fluid conduit means leading to the fluid pump, and means forming third fluid conduit means, the third fluid conduit means leading from the fluid pump to the first fluid conduit means, whereby fuel and air as a mixture flows into the inlet passage means and to the first fluid conduit means and to each of the combustion chambers, a portion of the fuel and air as a mixture flowing into each combustion chamber when the intake valve thereof is in an open position, whereby the remaining portion of the fuel and air as a mixture flows into the second fluid conduit means and to the fluid pump and then to the first fluid conduit means as the fuel and air as a mixture circulates in the first and second fluid conduit means and as portions of the mixture flow into each combustion chamber when the intake valve thereof is in an open position.

6. Fuel and air induction structure for an internal combustion engine which is provided with a plurality of combustion chambers and a plurality of intake port regions, there being an intake port region adjacent each of the combustion chambers, there being a plurality of intake valves, there being an intake valve operable to open and to close each combustion chamber and to open and to close fluid communication between the combustion chamber and the adjacent intake port region, comprising wall means forming a first fluid manifold, the first fluid manifold being in fluid communication with the intake port region of each of the combustion chambers, wall means forming a fluid entrance passage for flow of fuel and air as a mixture into the induction structure and to the first fluid manifold, means forming a plurality of intermediate conduit members, there being an intermediate conduit member partially positioned within each of the intake port regions, means forming a second fluid manifold, each of the intermediate conduit members being in fluid communication with the second fluid manifold, a continuously operating fluid pump, a housing enclosing the fluid pump, means forming first passage wall means, the first passage wall means providing fluid communication between the second fluid manifold and the housing of the fluid pump for flow of fluid from the second fluid manifold to the fuel pump, means forming second passage wall means, the second passage wall means providing fluid communication between the housing of the fluid pump and the first fluid manifold for flow of fuel and air as a mixture from the fluid pump to the first fluid manifold, whereby fuel and air as a mixture flows continuously as a main stream into the fluid entrance passage and into the first fluid manifold, the main stream of fuel and air as a mixture then flowing in the first fluid manifold and separating into separate streams as each separate stream flows into each intake port region, a portion of the separate streams of fuel and air as a mixture flowing into each of the combustion chambers from the respective intake port region when the respective intake valve of the combustion chamber i in an open position, the remainder of the separate stream of the fuel and air as a mixture flowing from each intake port region into the respective intermediate conduit member, the remainder of the separate stream of fuel and air as a mixture then flowing into the second fluid manifold, whereby a second main stream of fuel and air as a mixture is formed in the second fluid manifold, the second main stream of fuel and air as a mixture then flowing in the second fluid manifold to the fluid pump and from the fluid pump to the first fluid manifold, streams of the fuel and air as a mixture thus circulating from the first fluid manifold to the second fluid manifold and from the second fluid manifold to the first fluid manifold, portions of the streams of fuel and air as a mixture flowing into each of the combustion chambers when the intake valve thereof is in an open position.

7. The fuel and air induction structure of claim 6 in which each of the intake port regions is formed by walls which are heated by operation of the internal combustion engine and in which each intermediate conduit member has a flared end portion within its respective intake port region, the flared end portion deflecting fuel and air as a mixture as the mixture engages the flared end portion and the flared end portion directing the fuel and air as a mixture into engagement with the heated walls of the intake port region, whereby there is vaporization of the fuel in the fuel and air as a mixture.

8. The method of directing fuel and air as a mixture into the combustion chambers of an internal combustion engine which has a plurality of combustion chambers and in which each combustion chamber has an intake valve which has an open position and a closed position, and in which there are walls which form an intake port region adjacent each of the combustion chambers and leading to the combustion chamber, the walls of each intake port region being heated by operation of the internal combustion engine, comprising providing a first fluid manifold which is in fluid communication with the intake port region of each of the combustion chambers, providing a plurality of fluid conduit members, positioning a fluid conduit member in fluid communication with each of the intake port regions, providing a second fluid manifold, positioning the second fluid manifold in fluid communication with each of the fluid conduit members, introducing a continuous flow of fuel and air as a mixture into the first fluid manifold, forcing flow of fuel and air as a mixture within the first fluid manifold and forcing the fuel and air as a mixture to flow in separate streams from the first fluid manifold into each of the intake port regions, whereby a portion of each separate stream of the fuel and air as a mixture flows into each combustion chamber when the intake valve thereof is in an open position, forcing the remainder of each separate stream of the fuel and air as a mixture to flow from the respective intake port region into the respective fluid conduit member and into the second fluid manifold, whereby a main stream of fuel and air as a mixture is formed in the second fluid manifold, forcing the main stream of the fuel and air as a mixture to flow from the second fluid manifold into the first fluid manifold, whereby the fuel and air as a mixture is circulated from one fluid manifold to the other fluid manifold and whereby a portion of the fuel and air as a mixture flows into each combustion chamber when the intake valve thereof is in open position, and whereby hot gases may flow from each combustion chamber into the respective intake port region when the intake valve thereof is in an open position, and whereby the hot exhaust gases which flow from each intake port region and into the respective fluid conduit member and into the second fluid manifold are mixed with the fuel and air within the respective fluid conduit member.

9. The method of claim 8 in which the fluid conduit members which are provided have flared end portions, and in which the method includes forcing the fuel and air as a mixture to flow in separate streams from the first fluid manifold in engagement with the flared end of the respective fluid conduit, whereby the separate stream is deflected and directed by the flared end into engagement with the heated walls which form the intake port region, whereby the fuel in the fuel and air as a mixture is vaporized prior to flow of the fuel and air as a mixture into the respective combustion chamber.

10. The method of claim 8 in which each of the fluid conduit members which is provided has an end portion provided with a flared interior surface, whereby a collection surface is provided for flow of gases from the respective intake port region into the respective fluid conduit member.

* * * * *